US012421944B1

(12) United States Patent
Enke

(10) Patent No.: US 12,421,944 B1
(45) Date of Patent: Sep. 23, 2025

(54) STRAIGHT AXIS VARIABLE DISPLACEMENT PISTON PUMP WITH FEATURE TO MINIMIZE PISTON SIDE LOADING

(71) Applicant: Hamilton Sundstrand Corporation, Charlotte, NC (US)

(72) Inventor: Olaf Enke, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 18/748,330

(22) Filed: Jun. 20, 2024

(51) Int. Cl.
*F04B 1/324* (2020.01)
*F04B 1/126* (2020.01)
*F04B 1/2028* (2020.01)

(52) U.S. Cl.
CPC ..... *F04B 1/324* (2013.01); *F04B 1/126* (2013.01); *F04B 1/2028* (2013.01)

(58) Field of Classification Search
CPC ..... F04B 1/324; F04B 1/126; F04B 1/2028
See application file for complete search history.

(56) References Cited

U.S. PATENT DOCUMENTS 1,945,391 A * 1/1934 Benedek ..... F04B 1/2071 91/503
3,592,105 A 7/1971 Fryklund
3,641,829 A * 2/1972 Reynolds ..... F04B 1/126 91/507
3,661,058 A * 5/1972 Peron ..... F04B 1/20 91/488
3,682,047 A * 8/1972 Anderson ..... F04B 1/2078 91/505
5,079,996 A * 1/1992 Abousabha ..... F04B 1/324 417/222.1
5,205,123 A 4/1993 Dunstan
5,803,714 A * 9/1998 Tominaga ..... F02M 69/462 417/269
6,668,801 B2 12/2003 Smith et al.
10,174,746 B2 1/2019 Conde et al.
10,533,544 B2 * 1/2020 Funasaka ..... F03C 1/0671
10,808,686 B2 * 10/2020 Maekawa ..... F04B 1/2085
2004/0042910 A1 * 3/2004 Gleasman ..... F04B 1/126 417/269
2005/0172798 A1 8/2005 Kadlicko
(Continued)

FOREIGN PATENT DOCUMENTS

CN 104405606 A 3/2015
CN 105257495 B 8/2018
(Continued)

*Primary Examiner* — Jesse S Bogue
(74) *Attorney, Agent, or Firm* — Kinney & Lange, P.A.

(57) ABSTRACT

An axial variable displacement piston pump includes a drive shaft disposed on an axis, a piston barrel having a plurality of pistons disposed about and rotationally coupled to the drive shaft, a swash plate disposed about and rotationally coupled to the drive shaft, and a retention cage connected to the swash plate between the piston barrel and the swash plate. The swash plate and the piston barrel are configured to be simultaneously driven by the drive shaft and the swash plate is configured to tilt relative to the axis. The retention cage is configured to retain the plurality of pistons relative to the swash plate with rotation.

20 Claims, 5 Drawing Sheets

(56) References Cited

U.S. PATENT DOCUMENTS

| | | | | |
|---|---|---|---|---|
| 2009/0007773 | A1* | 1/2009 | Zhu | F04B 1/2078 417/269 |
| 2016/0069342 | A1 | 3/2016 | May | |
| 2017/0298912 | A1 | 10/2017 | Dyminski | |
| 2018/0051799 | A1 | 2/2018 | Yuan | |
| 2019/0113028 | A1 | 4/2019 | Hemink | |
| 2020/0392948 | A1 | 12/2020 | Lee et al. | |
| 2021/0095647 | A1 | 4/2021 | Parsons et al. | |
| 2021/0164456 | A1* | 6/2021 | Tricard | F04B 1/324 |
| 2021/0231112 | A1* | 7/2021 | Kawakita | F04B 1/124 |

FOREIGN PATENT DOCUMENTS

| | | | | |
|---|---|---|---|---|
| KR | 19980070979 | A * | 10/1998 | F04B 27/0878 |
| KR | 20020090245 | A * | 12/2002 | F04B 53/18 |

* cited by examiner

STRAIGHT AXIS VARIABLE DISPLACEMENT PISTON PUMP WITH FEATURE TO MINIMIZE PISTON SIDE LOADING

BACKGROUND

The present disclosure relates generally to pumps and more particularly to variable displacement piston pumps.

Variable displacement piston pumps can be used to pressurize and deliver fuel for aerospace fuel systems. Delivery flow can be adjusted by varying the inclination or tilt angle of a swash plate against which pistons reciprocate, which changes the stroke length of the pistons. Conventional variable displacement piston pumps have a rotating piston barrel with pistons that rotate against a swash plate that has a variable tilt angle but is rotationally fixed relative to rotation of the piston barrel. As the piston barrel rotates against the titled swash plate, pistons move in and out of their respective cylinders. Piston shoes provide an interface between the reciprocating pistons and the swash plate. The piston shoes slide over the surface of the swash plate as the piston barrel rotates. Piston head and piston shoes are retained relative to the swash plate by a retraction or retention plate, which helps guide pistons out of their respective cylinders as they reciprocate against the swash plate. The typical joints between piston heads and a retraction plate are ball joints with a retraction plate maintaining contact with the pistons during the compression stroke. As the swash plate angle changes, it can create varying radial forces on the reciprocating piston as the force applied to the piston is not always perfectly aligned with the piston's axis. This radial load can eventually cause the piston to have high contact stress between a piston outer diameter and cylinder inner diameter due to side loading, which can cause scuffing especially at higher temperatures and pressures. The increased friction caused by sideloading can additionally result in heat generation and pump drive efficiency losses. Additionally, the continuous sliding of the piston shoes against the swash plate can increase or cause uneven wear, resulting in lowered efficiency and increased risk of failure. Friction between a piston shoe and the swash plate becomes more critical with higher fuel temperatures and pressures.

More robust variable displacement piston pump designs are needed for applications requiring higher fuel temperatures and pressures.

SUMMARY

This disclosure presents an axial variable displacement piston pump that includes a drive shaft disposed on an axis, a piston barrel having a plurality of pistons disposed about and rotationally coupled to the drive shaft, a swash plate disposed about and rotationally coupled to the drive shaft, and a retention cage connected to the swash plate between the piston barrel and the swash plate. The swash plate and the piston barrel are configured to be simultaneously driven by the drive shaft and the swash plate is configured to tilt relative to the axis. The retention cage is configured to retain the plurality of pistons against the swash plate with rotation.

The present summary is provided only by way of example, and not limitation. Other aspects of the present disclosure will be appreciated in view of the entirety of the present disclosure, including the entire text, claims and accompanying figures.

BRIEF DESCRIPTION OF THE DRAWINGS

FIG. 1A shows swash plate in a neutral position. FIG. 1B shows swash plate disposed at a 15-degree tilt angle.

Figure 1A:
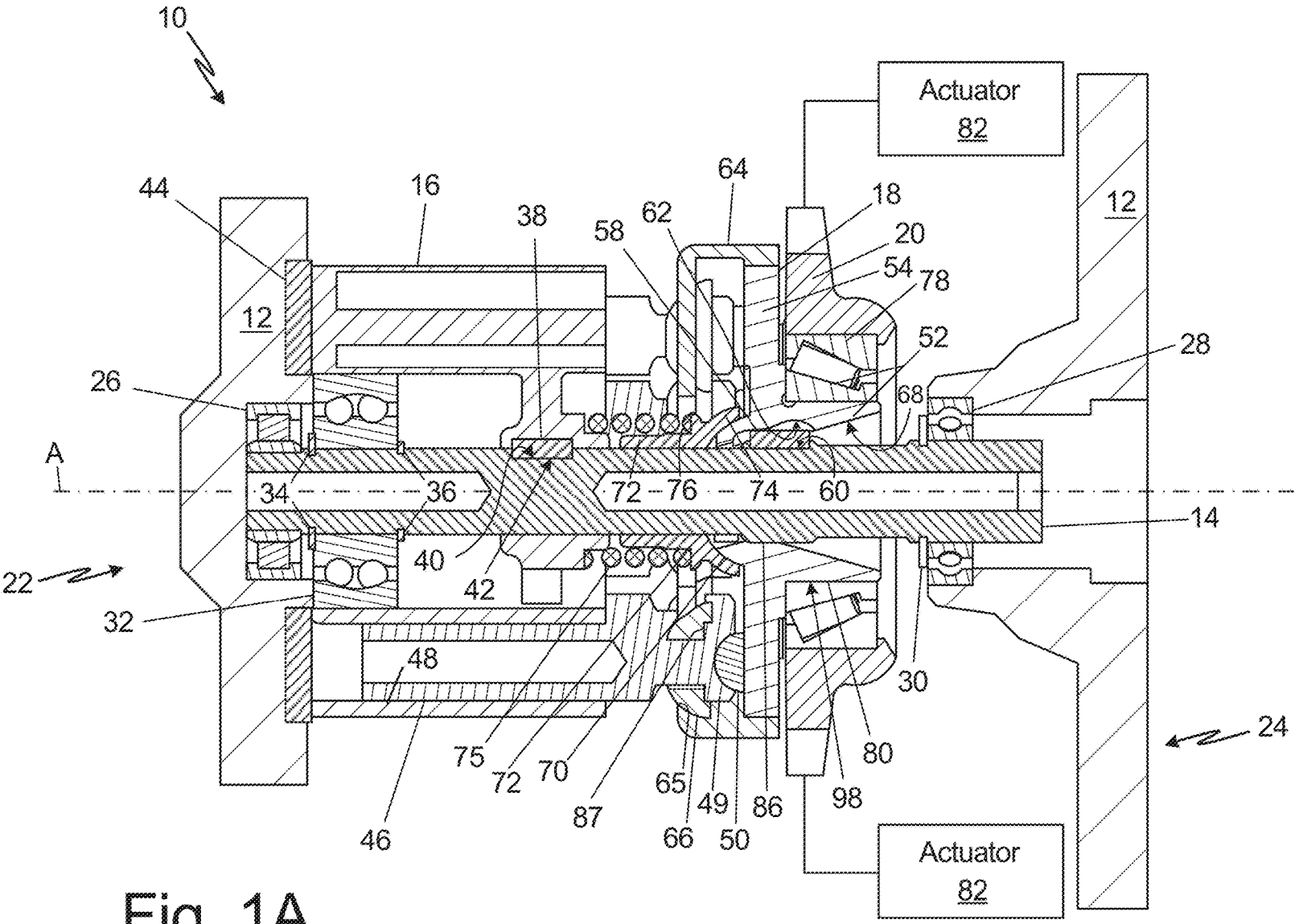
FIGS. 1A and 1B are cross-sectional views of a straight axis variable displacement piston pump having co-rotating piston barrel and swash plate.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

Figure 1B:
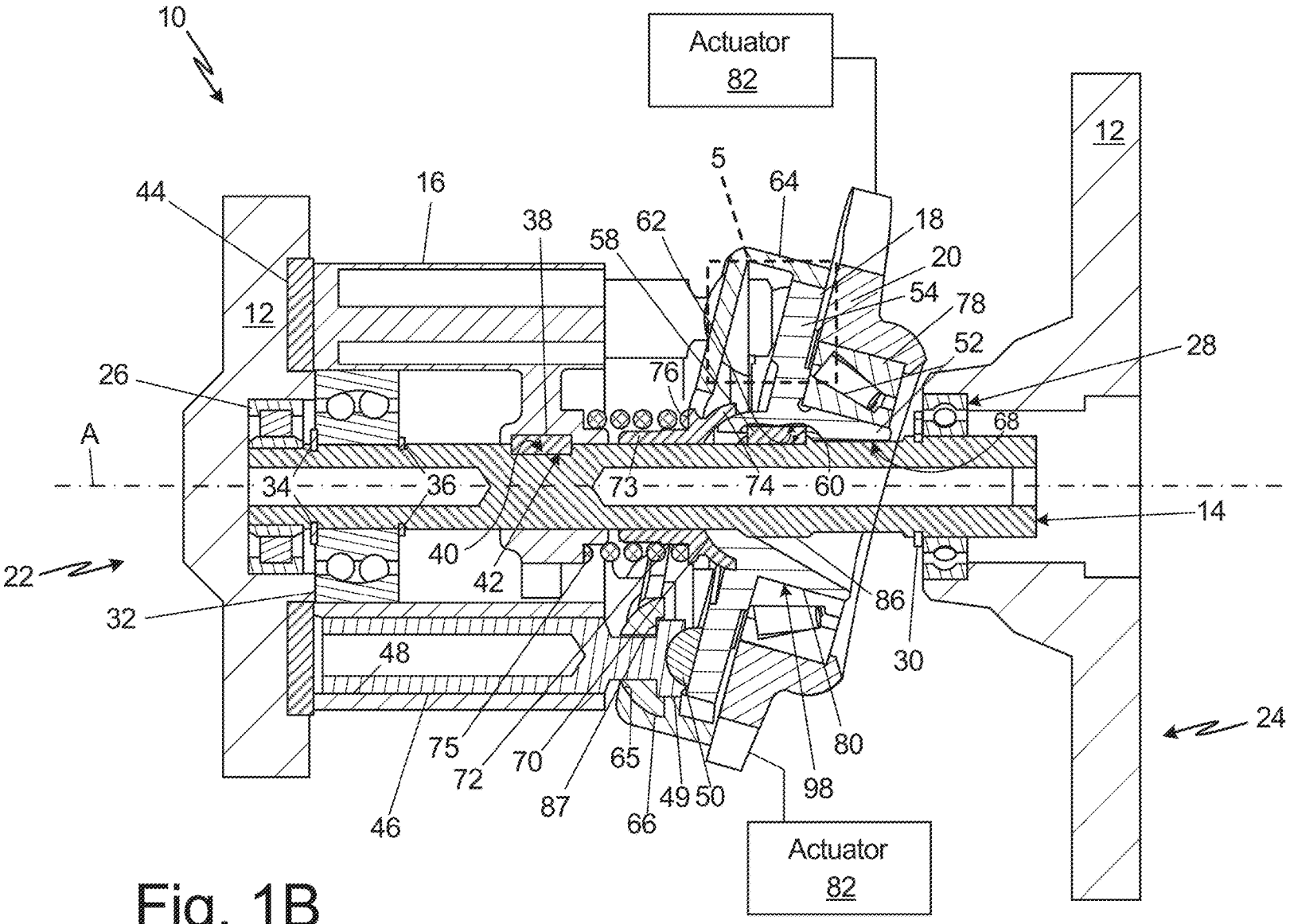

FIGS. 1A and 1B are cross-sectional views of a straight axis variable displacement piston pump, referred to hereinafter as pump 10. FIG. 1A shows a swash plate in a neutral position. FIG. 1B shows the swash plate disposed at a 15-degree tilt angle. FIGS. 1A and 1B show pump 10, housing 12, drive shaft 14, piston barrel 16, swash plate 18, and base plate 20. FIGS. 1A and 1B are discussed together herein.

Housing 12 can enclose internal components of pump 10 between first end 22 and second end 24 and supports drive shaft 14. A fluid inlet (not shown) and fluid outlet (not shown) to piston barrel 16 can be provided in first end 22 of housing 12. Drive shaft 14 is disposed on axis A and received in housing 12 at first end 22 and second end 24. Drive shaft 14 can be rotationally supported at first end 22 of housing 12 by bearing 26 and at second end 24 of housing 12 by bearing 28. As shown in FIGS. 1A and 1B, bearing 26 can be, for example, a cylindrical roller bearing suitable for handling high radial load and allows for an axial elongation of the drive shaft during high pump fuel operation temperatures. Bearing 28 can be, for example, a ball bearing. Retaining ring 30 can retain an axial position of bearing 28. Retaining ring 30 can be, for example, a circlip. Retaining ring 30 can be received in a slot (not shown) in drive shaft 14. Drive shaft 14 is configured to drive rotation of piston barrel 16 and swash plate 18.

Piston barrel 16 is disposed adjacent to first end 22 of housing 12. Piston barrel 16 is disposed on axis A and is supported on drive shaft 14 by bearing 32. Bearing 32 can be a self-aligning ball bearing configured to maintain alignment of piston barrel 16 in housing 12. Retaining rings 34 and 36 can be disposed on either side of bearing 32 on drive shaft 14 to retain an axial position of bearing 32 on drive shaft 14. Retaining rings 34 and 36 can be, for example, circlips. Retaining rings 34 and 36 can be received in respective slots (not shown) in drive shaft 14. Piston barrel 16 can be rotationally fixed to drive shaft 14 by key 38. Key 38 can be a block received in key seat or slot 40 in drive shaft 14 and keyway or slot 42 in piston barrel 16. Key 38 can be configured to transfer torque from drive shaft 14 to piston barrel 16. Key 38 and corresponding slots 40 and 42 can block circumferential movement of piston barrel 16 with respect to drive shaft 14.

Piston barrel 16 can rotate against thrust plate 44 disposed between piston barrel 16 and housing 12. Thrust plate 44 can provide a sliding and sealing interface between rotating piston barrel 16 and stationary housing 12. Thrust plate 44 can help accommodate axial load of reciprocating pistons 46 housed in piston barrel 16 and prevent fluid leaks.

Piston barrel 16 includes a plurality of circumferentially spaced cylinder bores 48 within which pistons 46 are slidingly received. Pistons 46 reciprocate in cylinder bores 48, as known in the art, to draw fluid into piston barrel 16 through housing 12 at first end 22 and discharge fluid from piston barrel 16 through housing 12 at first end 22. Pistons 46 reciprocate as they rotate with a titled swash plate 18 as shown in FIG. 1B.

A piston head 49 of each piston 46 is received in a piston shoe 50, which is placed adjacent to swash plate 18. As shown in FIGS. 1A and 1B and described further herein, piston shoe 50 can have a hemispherical shape having a flat surface disposed on swash plate 18 and a convex surface received in a concave piston head 49 of piston 46. Piston shoes 50 are free to slide radially against swash plate 18 as pistons 46 reciprocate. Piston heads 49 are free to pivot about piston shoes 50 as pistons 46 move in and out of their respective cylinder bores 48. Piston shoes 50 are rotationally coupled to each of pistons 46 and swash plate 18, which minimizes heat produced by friction and wear as compared to prior art designs in which the swash plate and piston barrel are not rotationally coupled.

Swash plate 18 is disposed on axis A between pistons 46 and base plate 20. Swash plate 18 includes hub 52 and disc 54. Hub 52 is received on drive shaft 14. Disc 54 extends radially outward from hub 52. Swash plate 18 can be rotationally fixed to drive shaft 14 by key 58. Key 58 can be received in key seat or slot 60 in drive shaft 14 and in keyway or slot 62 in swash plate 18. Key 58 can be configured to transfer torque from drive shaft 14 to swash plate 18. Key 58 and corresponding slots 60 and 62 are configured to block circumferential movement of swash plate 18 relative to drive shaft 14 while allowing swash plate 18 to pivot relative to drive shaft 14.

Disc 54 interfaces with piston shoes 50. Retention cage 64 is provided on swash plate 18 to retain piston shoes 50 and corresponding piston heads 49 against swash plate 18 with a defined clearance 63 (shown in FIG. 5) between 0.1-0.3 mm provided during a suction stroke. Retention cage 64 is fixed to disc 54 of swash plate 18 to rotate therewith. As shown in FIGS. 1A and 1B, retention cage can be fixed to an outer diameter of disc 54. As discussed further herein, retention cage 64 can include a plurality of circumferentially spaced openings 65 configured to receive piston heads 49. Retention members 66 can be disposed around pistons 46 adjacent to piston heads 49 to retain piston heads 49 in retention cage 64 and reduce sideloading of pistons 46, as described further herein.

Hub 52 can interface with drive shaft 14 via key 58. As described further herein, hub 52 can have a radially inner surface 68 that is configured to allow tilting of disc 54 relative to axis A and piston barrel 16 without interference from drive shaft 14. A variable inclination or tilt angle of swash plate 18 controls the stroke length of pistons 46.

A forward end 70 of hub 52 can be received in socket 72. Socket 72 can be disposed about drive shaft 14 between piston barrel 16 and swash plate 18. Socket 72 can include sleeve 73 and cradle 74. Sleeve 73 can form a forward end of socket 72 and interface with drive shaft 14. Cradle 74 can form an aft end of socket 72 and is configured to receive forward end 70 of swash plate 18. Cradle 74 can have a concave surface extending outward from drive shaft 14 and configured to receive a corresponding surface of hub forward end 70. Hub 52 is free to rock within cradle 74 as the tilt angle of swash plate 18 is varied.

Spring 75 can be disposed about sleeve 73 of socket 72 between cradle 74 and piston barrel 16. Socket 72 can have an annular flange 76 extending radially outward from sleeve 73 adjacent to cradle 74 which spring 75 axially abuts. Flange 76 can retain spring 75 between cradle 74 and piston barrel 16. Spring 75 can bias socket 72 against swash plate 18 and accommodate changes in axial load exerted by pistons 46 against swash plate 18. Spring 75 can further support a constant contact between piston barrel 16 and thrust plate 44.

Swash plate 18 is rotationally coupled to base plate 20 by bearing 78. Base plate 20 is rotationally fixed with respect to swash plate 18. Bearing 78 can be disposed adjacent to disc 54 at an aft end 80 of hub 52 opposite socket 72. Bearing 78 is configured to allow swash plate 18 to rotate with respect to base plate 20. An axial load acting on swash plate 18 by pistons 46 is transferred to base plate 20 through bearing 78, thereby minimizing production of heat due to friction as compared to prior art designs in which the swash plate and piston barrel are not rotationally coupled. Swash plate 18 is centered through bearing 78 to avoid any unbalancing during rotation. In some examples, as illustrated in FIGS. 1A and 1B, bearing 78 can be a tapered roller bearing, which can provide high axial load transmission from swash plate 18 to base plate 20. In other examples, alternative bearings, including ball bearings with a shoulder, may be suitable for transmitting the axial load and maintaining balance with rotation and tilting of swash plate 18.

Base plate 20 is configured to vary the tilt angle of swash plate 18. Base plate 20 can be connected to one or more actuators 82 (shown schematically). One or more actuators 82 are configured to tilt base plate 20 and thereby swash plate 18 with respect to drive shaft 14 and axis A.

As piston barrel 16 and swash plate 18 rotate, the tilted swash plate 18 (FIG. 1B) converts rotary motion of piston barrel 16 to reciprocating motion of pistons 46. As piston barrel 16 and swash plate 18 rotate, pistons 46 are pushed in and out of their respective cylinder bores 48 against swash plate 18. The tilt angle of swash plate 18 determines the stoke length of pistons 46. When swash plate 18 is tilted relative to axis A and drive shaft 14, pistons 46 are pushed in and out of their respective cylinder bores 48 by swash plate 18 as piston barrel 16 and swash plate 18 rotate. The tilt angle of swash plate 18 can be adjusted to increase or decrease volumetric flow from pump 10. When the tilt angle is increased, the volumetric output is increased. The tilt angle of swash plate 18 can be automatically adjusted based on the fuel system's pressure or volumetric flow requirements as known in the art.

Figure 4:
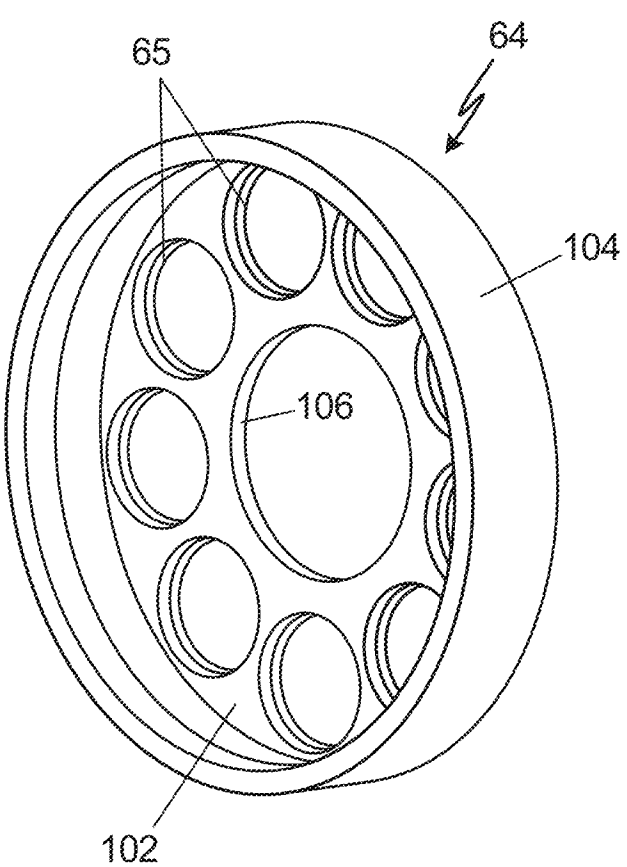
FIG. 4 is a perspective view of a retention cage of FIG. 1 configured for use with the retention member of FIGS. 3A and 3B to retain the piston of FIG. 2 relative to the swash plate.
Figure 3B:
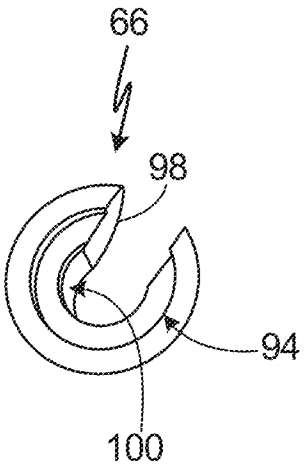
FIGS. 3A and 3B are perspective views of a retention member configured use with the piston of FIG. 2.
Figure 3A:
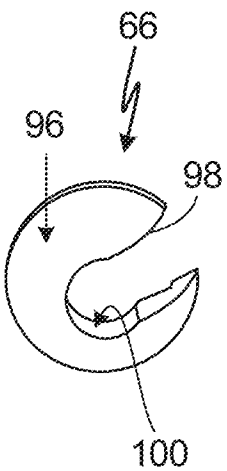
Figure 2:
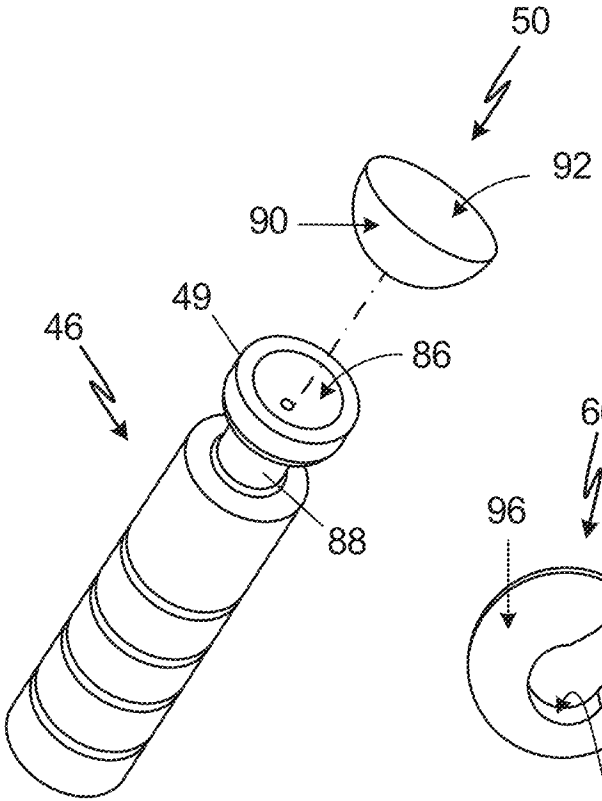
FIG. 2 is an exploded view of a piston and piston shoe of the pump of FIG. 1.
Figure 5:
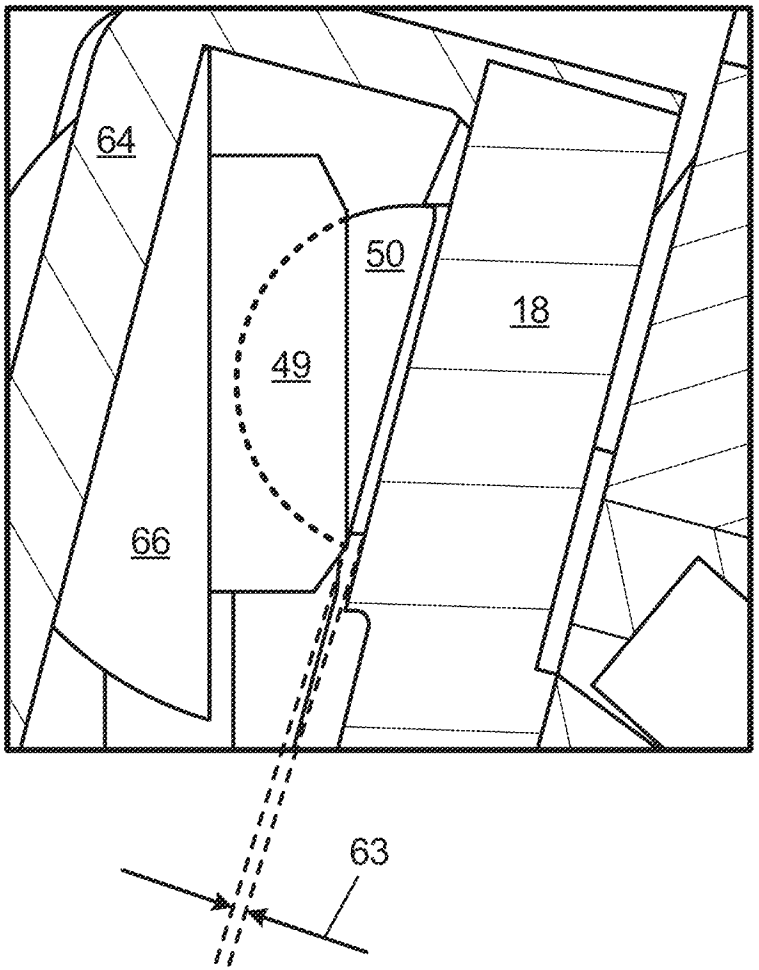
FIG. 5 is an enlarged view of portion 5 of FIG. 1B.

FIG. 2 is an exploded view of piston 46 and piston shoe 50. FIGS. 3A and 3B are perspective views of retention member 66. FIG. 4 is a perspective view of retention cage 64. FIG. 5 is an enlarged view of portion 5 of FIG. 1B. FIGS. 2, 3A, 3B, 4, and 5 are discussed together herein in relation to FIGS. 1A and 1B.

FIG. 2 shows piston 46 having piston head 49, shoe seat 86, retention seat 87 (shown in FIG. 1A), and neck 88, and piston shoe 50 having spherical surface 90 and sliding surface 92. FIGS. 3A and 3B show retention member 66 having first surface 94, second surface 96, and opening 98. FIG. 4 shows retention cage 64 having plate 102, annular flange 104, central opening 106, and circumferentially spaced openings 65.

Piston head 49 has a shoe seat 86 at an axially outermost end configured to receive spherical surface 90 of piston shoe 50. Shoe seat 86 can have a spherical surface. The spherical surface of shoe seat 86 and spherical surface 90 are complimentary surfaces configured to allow piston head 49 to slidingly pivot about piston shoe 50 as piston 46 moves in and out of cylinder bore 48 with rotation of piston barrel 16 and swash plate 18.

Sliding surface 92 is configured to contact swash plate 18. Sliding surface 92 can be a smooth flat surface capable of sliding against swash plate 18. As previously described, piston shoe 50 rotates with swash plate 18 and pistons 46, thereby limiting wear on swash plate 18 and sliding surface 92 of piston shoe 50. Because the rotational axis of a tilted swash plate 18 is at an angle relative to the rotational axis of piston barrel 16, the longitudinal contact point of pistons 46 varies, following an elliptical path with each rotation. This causes slight radial sliding of piston shoes 50 relative to drive shaft 14 against swash plate 18 with rotation.

A small gap or clearance 63 (shown in FIG. 5) is provided between sliding surface 92 and swash plate 18 to allow lubrication film to build up between piston shoe 50 and swash plate 18. During the suction stroke of the piston there will be no axial loads between shoe 50, suction shoe seat 86 and swash plate 18, so that the fuel will lubricate these contact surfaces as the pistons rotate inside the pump housing, which is filled with fuel. This rotation of the pistons inside the pump housing will create a lubrication film for the next compression stroke of the piston. Clearance 63 is equal to or less than 0.3 mm and, preferably between 0.1 and 0.2 mm. Clearances 63 larger than 0.3 mm can allow piston shoe 50 to tilt in piston head 49 and with respect to swash plate 18, which can cause higher undesired impact loading. Clearances 63 less than 0.1 mm may not permit sufficient fuel between the contact surfaces to form a lubrication film.

Retention members 66 are configured to provide an interface between pistons 46 and retention cage 64 that minimizes side loading of pistons 46. As shown in FIGS. 3A and 3B, retention member 66 can be a collar having opening 98 configured to receive neck 88 of piston 46. Opening 98 can have a semicylindrical portion 100 configured to receive neck 88. A diameter of semicylindrical portion 100 is larger than a diameter of neck 88, forming a gap between retention member 66 and neck 88, as shown in FIG. 1A. First surface 94 of retention member 66 can be flat to be seated on a corresponding flat surface of retention seat 87 (shown in FIG. 1A) of piston head 49. Second surface 96 opposite first surface 94 of retention member 66 can have a curved hemispherical surface configured to interface with retention cage 64.

Retention cage 64, as shown in FIG. 4, can be an annular body. Retention cage 64 can have plate 102, annular flange 104, central opening 106, and circumferentially spaced openings 65. Annular flange 104 can extend perpendicular to plate 102. Annular flange 104 can be configured to be joined to a radially outer edge of swash plate 18 as shown in FIGS. 1A and 1B. Plate 102 includes central opening 106 and circumferentially spaced openings 65. Central opening 106 can be centrally located to receive socket 72 (shown in FIGS. 1A and 1B). Circumferentially spaced openings 65 are disposed around central opening 106 and configured to receive pistons 46.

Retention members 66 are retained between plate 102 of retention cage 64 and swash plate 18. Openings 65 have diameter smaller than a diameter of retention members 66 but larger than a diameter of pistons 46. A portion of second surface 96 can protrude outward from openings 65 such that plate 102 interfaces with varying portions of the spherical second surface 96 as pistons 46 reciprocate with rotation. Retention member 66 are free to slide about piston head 49 with rotation and reciprocation of pistons 46 and adjust to a location of openings 65 in retention cage 64. A small clearance between retention members 66 and plate 102 can be formed along a surface nearest drive shaft 14 as pistons are pushed into cylinders. The clearance provided between neck 88 of piston 46 and between retention member 66 allows radial movement of retention members 66. The radial adjustment of retention members 66 can reduce or eliminate a radial force applied to pistons 46 thereby reducing or eliminating side loading. As retention members 66 are free to slide about piston head 49 and within openings 65, a lubrication film can be created between interfacing surfaces, supporting sliding of retention member 66 on a surface of retention cage 64 to further reduce the potential for side loading.

Figure 6:
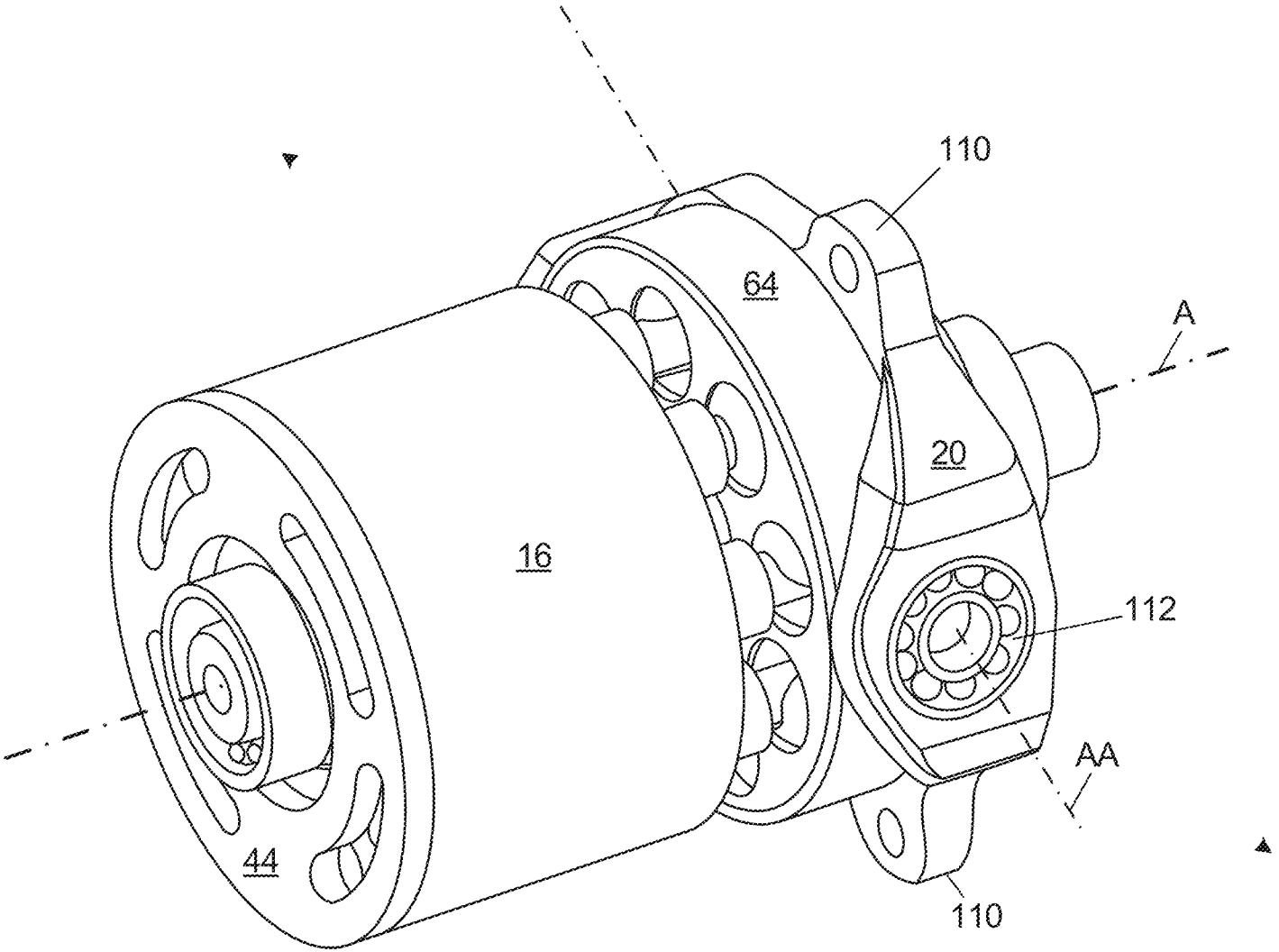
FIG. 6 is a perspective view of a portion of the pump of FIGS. 1A and 1B.

FIG. 6 is a perspective view of a portion of pump 10. FIG. 6 shows piston barrel 16, base plate 20, thrust plate 44, pistons 46, and retention cage 64. Base plate 20 can include actuation connections 110 and bearing 112 disposed on axis AA. Each of actuation connections 110 can be coupled to an actuation arm (not shown) configured to pivot base plate 20 about axis AA to change the tilt angle of swash plate 18 (shown in FIGS. 1A and 1B). Axis AA is perpendicular to axis A. Base plate 20 can be supported by housing 12 (not shown) via bearing 112. Bearing 112 allows base plate 20 to pivot around axis AA to vary the tilt angle of swash plate 18 connected thereto via bearing 78 (shown in FIGS. 1A and 1B).

The disclosed axial variable displacement piston pump having co-rotating swash plate and piston barrel and features that minimize side loading of the pistons provides increased robustness at higher fluid temperatures and pressures than prior art designs. The components disclosed herein can be utilized to reduce pump weight and cost.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like.

Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

DISCUSSION OF POSSIBLE EMBODIMENTS

The following are non-exclusive descriptions of possible embodiments of the present invention.

An axial variable displacement piston pump includes a drive shaft disposed on an axis, a piston barrel having a plurality of pistons disposed about and rotationally coupled to the drive shaft, a swash plate disposed about and rotationally coupled to the drive shaft, and a retention cage connected to the swash plate between the piston barrel and the swash plate. The swash plate and the piston barrel are configured to be simultaneously driven by the drive shaft and the swash plate is configured to tilt relative to the axis. The retention cage is configured to retain the plurality of pistons relative to the swash plate with rotation.

The axial variable displacement piston pump of the preceding paragraph can optionally include, additionally and/or alternatively, any one or more of the following features, configurations, and/or additional components:

An embodiment of the preceding axial variable displacement piston pump can further include a plurality of piston shoes disposed on the swash plate and coupled to the plurality of pistons, wherein the plurality of piston shoes and plurality of pistons coupled thereto are retained relative to the swash plate by the retention cage with a clearance between the plurality of piston shoes and swash plate to accommodate a lubrication film.

In an embodiment of any of the preceding axial variable displacement piston pumps, the clearance can be between 0.1 and 0.3 mm.

An embodiment of any of the preceding axial variable displacement piston pumps can further include a plurality of retention members disposed between the retention cage and a head of the plurality of pistons.

In an embodiment of any of the preceding axial variable displacement piston pumps, the head of the plurality of pistons can have a concave surface configured to receive the plurality of piston shoes.

In an embodiment of any of the preceding axial variable displacement piston pumps, the plurality of piston shoes can have a hemispherical shape having a flat surface configured to interface with the swash plate and a curved surface configured to be received in the head of the plurality of pistons.

In an embodiment of any of the preceding axial variable displacement piston pumps, the piston head can be free to slidingly pivot about the curved surface.

In an embodiment of any of the preceding axial variable displacement piston pumps, the plurality of retention members can have a curved surface configured to interface with the retention cage.

In an embodiment of any of the preceding axial variable displacement piston pumps, the retention cage can include a plurality of circumferentially spaced openings configured to receive the plurality of pistons and wherein a portion of the curved surface of the plurality of retention members protrudes through the plurality of circumferentially spaced openings.

In an embodiment of any of the preceding axial variable displacement piston pumps, the plurality of pistons can include a neck adjacent to the head, the neck having a smaller diameter than the piston head and configured to receive a retention member of the plurality of retention members.

In an embodiment of any of the preceding axial variable displacement piston pumps, the plurality of retention members can be free to move relative to the plurality of pistons and the retention cage.

In an embodiment of any of the preceding axial variable displacement piston pumps, the head of the plurality of pistons can include a flat surface opposite the concave surface, the flat surface configured to interface with a flat surface of the retention member, wherein the flat surface of the retention member is opposite the curved surface.

In an embodiment of any of the preceding axial variable displacement piston pumps, the plurality of circumferentially spaced openings can have a diameter greater than a diameter of the plurality of pistons including the piston head.

In an embodiment of any of the preceding axial variable displacement piston pumps, the plurality of circumferentially spaced openings can have a diameter smaller than a diameter of the plurality of retention members.

In an embodiment of any of the preceding axial variable displacement piston pumps, the retention cage can include a plate and an annular flange extending therefrom, the plate comprising the plurality of circumferentially spaced openings and the annular flange connected to an outer diameter of the swash plate.

An embodiment of any of the preceding axial variable displacement piston pumps can further include a lubricating film provided on the curved surface of the plurality of retention members.

An embodiment of any of the preceding axial variable displacement piston pumps can further include a base plate coupled to the swash plate by a first bearing, wherein the base plate is rotationally fixed relative to the first axis and rotatable about the second axis, the base plate configured to tilt the swash plate.

In an embodiment of any of the preceding axial variable displacement piston pumps, the base plate can be mechanically coupled to an actuator, the actuator configured to vary a tilt angle of the base plate relative to the first axis.

In an embodiment of any of the preceding axial variable displacement piston pumps, the first bearing can be a tapered roller bearing.

An embodiment of any of the preceding axial variable displacement piston pumps can further include a second bearing disposed between the piston cylinder and the drive shaft, wherein the second bearing is a self-aligning ball bearing.

The invention claimed is:

1. An axial variable displacement piston pump comprising:

a drive shaft disposed on a first axis;

a piston barrel disposed about and rotationally coupled to the drive shaft, the piston barrel comprising a plurality of pistons;

a swash plate disposed about and rotationally coupled to the drive shaft, the swash plate and the piston barrel configured to be simultaneously driven by the drive shaft, wherein the swash plate is configured to tilt about a second axis; and a retention cage connected to the swash plate and extending between the piston barrel and the swash plate, the retention cage configured to retain the plurality of pistons relative to the swash plate with rotation of the swash plate.

2. The axial variable displacement piston pump of claim 1 and further comprising a plurality of piston shoes disposed on the swash plate and coupled to the plurality of pistons, wherein the plurality of piston shoes and plurality of pistons coupled thereto are retained relative to the swash plate by the retention cage with a clearance between the plurality of piston shoes and swash plate to accommodate a lubrication film.

3. The axial variable displacement piston pump of claim 2, wherein the clearance is between 0.1 and 0.3 mm.

4. The axial variable displacement piston pump of claim 2 and further comprising a plurality of retention members disposed between the retention cage and a head of the plurality of pistons.

5. The axial variable displacement piston pump of claim 4, wherein the head of the plurality of pistons has a concave surface configured to receive the plurality of piston shoes.

6. The axial variable displacement piston pump of claim 5, wherein the plurality of piston shoes has a hemispherical shape having a flat surface configured to interface with the swash plate and a curved surface configured to be received in the head of the plurality of pistons.

7. The axial variable displacement piston pump of claim 6, wherein the piston head is free to slidingly pivot about the curved surface.

8. The axial variable displacement piston pump of claim 2, wherein the plurality of retention members has a curved surface configured to interface with the retention cage.

9. The axial variable displacement piston pump of claim 8, wherein the retention cage comprises a plurality of circumferentially spaced openings configured to receive the plurality of pistons and wherein a portion of the curved surface of the plurality of retention members protrudes through the plurality of circumferentially spaced openings.

10. The axial variable displacement piston pump of claim 9, wherein the plurality of pistons comprise a neck adjacent to the head, the neck having a smaller diameter than the piston head and configured to receive a retention member of the plurality of retention members.

11. The axial variable displacement piston pump of claim 8, wherein the plurality of retention members is free to move relative to the plurality of pistons and the retention cage.

12. The axial variable displacement piston pump of claim 11, wherein the head of the plurality of pistons comprises a flat surface opposite the concave surface, the flat surface configured to interface with a flat surface of the retention member, wherein the flat surface of the retention member is opposite the curved surface.

13. The axial variable displacement piston pump of claim 11, wherein the plurality of circumferentially spaced openings has a diameter greater than a diameter of the plurality of pistons including the piston head.

14. The axial variable displacement piston pump of claim 11, wherein the plurality of circumferentially spaced openings has a diameter smaller than a diameter of the plurality of retention members.

15. The axial variable displacement piston pump of claim 11, wherein the retention cage comprises a plate and an annular flange extending therefrom, the plate comprising the plurality of circumferentially spaced openings and the annular flange connected to an outer diameter of the swash plate.

16. The axial variable displacement piston pump of claim 11 and further comprising a lubricating film provided on the curved surface of the plurality of retention members.

17. The axial variable displacement piston pump of claim 11, and further comprising a base plate coupled to the swash plate by a first bearing, wherein the base plate is rotationally fixed relative to the first axis and rotatable about the second axis, the base plate configured to tilt the swash plate.

18. The axial variable displacement piston pump of claim 17, wherein the base plate is mechanically coupled to an actuator, the actuator configured to vary a tilt angle of the base plate relative to the first axis.

19. The axial variable displacement piston pump of claim 17, wherein the first bearing is a tapered roller bearing.

20. The axial variable displacement piston pump of claim 17 and further comprising a second bearing disposed between the piston cylinder and the drive shaft, wherein the second bearing is a self-aligning ball bearing.

* * * * *